US009609997B2

(12) United States Patent
Fryman et al.

(10) Patent No.: US 9,609,997 B2
(45) Date of Patent: Apr. 4, 2017

(54) SYSTEMS AND METHODS FOR DETECTING APPLIANCE PUMP CAVITATION OR DRY STATE

(71) Applicant: General Electric Company, Schenectady, NY (US)

(72) Inventors: Mark Thomas Fryman, Louisville, KY (US); Meher Prasadu Kollipara, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 939 days.

(21) Appl. No.: 13/937,493

(22) Filed: Jul. 9, 2013

(65) Prior Publication Data

US 2015/0019026 A1 Jan. 15, 2015

(51) Int. Cl.
*A47L 15/00* (2006.01)
*A47L 15/42* (2006.01)

(52) U.S. Cl.
CPC ..... *A47L 15/4225* (2013.01); *A47L 15/0049* (2013.01); *A47L 2401/08* (2013.01); *A47L 2501/05* (2013.01)

(58) Field of Classification Search
None
See application file for complete search history.

(56) References Cited

U.S. PATENT DOCUMENTS 5,284,523 A * 2/1994 Badami ..... A47L 15/4244 134/18
5,330,580 A * 7/1994 Whipple, III ..... A47L 15/0047 134/18
7,064,517 B2 6/2006 Kiuchi et al.
7,621,283 B2 11/2009 Zentner et al.
8,277,571 B2 10/2012 Didat
8,894,776 B2 * 11/2014 Gnadinger ..... A47L 15/0049 134/56 D
2004/0261434 A1 * 12/2004 Zentner ..... F25C 1/04 62/137
2006/0219262 A1 * 10/2006 Peterson ..... A47L 15/4244 134/18
2007/0028948 A1 * 2/2007 Pardini ..... A47L 15/4225 134/25.2

(Continued)

FOREIGN PATENT DOCUMENTS

WO WO 9859174 12/1998

*Primary Examiner* — Ronald Hartman, Jr.
(74) *Attorney, Agent, or Firm* — Dority & Manning, P.A.

(57) ABSTRACT

Systems and methods for detecting appliance pump cavitation or dry state are provided. An exemplary appliance can include a current measurement circuit configured to provide a feedback signal that describes an inverter current drawn by an inverter providing three-phase power to the pump motor. A control unit of an appliance can detect pump cavitation and dry state by monitoring the feedback signal. Another exemplary appliance can include a motor speed detection circuit configured to provide a motor speed signal describing the speed of the pump motor. The control unit of the appliance can monitor variance in pump motor speed to detect pump dry state or cavitation. An exemplary method includes monitoring either an inverter current used by an inverter to drive a motor or a variance in a rotational speed of the motor.

11 Claims, 13 Drawing Sheets

(56) References Cited

U.S. PATENT DOCUMENTS

| | | | | |
|---|---|---|---|---|
| 2008/0163930 | A1* | 7/2008 | Ha | A47L 15/0031 137/1 |
| 2008/0196749 | A1* | 8/2008 | Kim | A47L 15/4293 134/57 D |
| 2010/0186772 | A1* | 7/2010 | Hatfield | A47L 15/0021 134/18 |
| 2011/0241723 | A1* | 10/2011 | Abel | G01R 31/343 324/765.01 |
| 2012/0048302 | A1* | 3/2012 | Didat | A47L 15/0023 134/25.2 |
| 2012/0312325 | A1* | 12/2012 | Gnadinger | A47L 15/0049 134/18 |
| 2015/0116026 | A1* | 4/2015 | Kang | H02M 5/2573 327/452 |

* cited by examiner

SYSTEMS AND METHODS FOR DETECTING APPLIANCE PUMP CAVITATION OR DRY STATE

FIELD OF THE INVENTION

The present disclosure generally relates to operation of a pump in an appliance. More particularly, the present disclosure relates to systems and methods for detecting pump cavitation and dry state based on pump motor performance characteristics.

BACKGROUND OF THE INVENTION

Dishwasher appliances generally include one or more pumps, such as a wash pump or drain pump. The wash pump can circulate liquid throughout a wash chamber of the dishwasher, for washing or rinsing items contained therein. The drain pump can remove liquid from the wash chamber of the appliance. For example, liquid can collect in a sump disposed at a bottom of the wash chamber during operation of the dishwasher appliance and the drain pump can be operated to urge such liquid from the sump to a drain where the liquid can flow out of the appliance.

However, both the wash pump and the drain pump can experience cavitation or can enter into a dry state. For example, when the wash pump is not fully primed with liquid it will experience cavitation, thus intermittently experiencing both wet states and dry states. Likewise, when the drain pump has successfully drained all of the liquid from the sump, it will enter a dry state.

Operation of a pump while experiencing cavitation or during a dry state can result in several distinct problems. One problem includes the creation of undesirable noise. In particular, operation of a pump during cavitation or in a dry state can create much louder noise than operation of the pump in a wet state. Increased noise can reduce user satisfaction. Further, increased noise above certain levels can cause a dishwasher to be non-compliant with regulations governing appliance sound levels.

Another problem caused by operation of a pump during cavitation or a dry state is that it results in the unnecessary use of energy. In particular, appliance energy consumption should be minimized to keep energy costs low and to meet regulatory requirements or other certification standards. Thus, such unnecessary use of energy should be eliminated.

Yet another problem is that operation of a pump during cavitation or a dry state may cause pitting or other damage to the pump itself or to other system components.

In particular, certain dishwashers can also include one or more heating elements which serve to heat the wash water. Operation of the heating elements while the wash pump is in a dry state (i.e. wash water is not circulating through the system) can be dangerous to both the dishwasher integrity and to user safety. For example, if energized in the absence of water to heat, the heating elements can potentially overheat and catch fire, a potentially disastrous situation. As another example, a non-resettable fuse can protect the heating elements from overheating. When the non-resettable fuse blows, the user can be required to place a service call, costing both time and money.

Previous attempts at solving the above noted problems have failed or are undesirable for particular reasons. For example, dishwasher drain heights can vary from one model to another or can be constrained at installation. Therefore, it can be difficult to finely tune drain pump operation time based on physical drain characteristics. As another example, attempts to minimize drain pump dry state operation by simply reducing total drain time can result in air lock, failure to fully drain, or other undesirable results.

Thus, improved systems and methods for detecting dishwasher pump cavitation and dry state are desired.

BRIEF DESCRIPTION OF THE INVENTION

Additional aspects and advantages of the invention will be set forth in part in the following description, or may be apparent from the description, or may be learned through practice of the invention.

One aspect of present disclosure is directed to an appliance. The appliance includes a control unit that includes a processor and a memory. The appliance also includes a pump that includes a three-phase motor. The appliance includes an inverter for providing three-phase power to the three-phase motor and a current measurement circuit configured to provide a feedback signal describing an inverter current drawn by the inverter across a DC bus. The control unit is configured to perform operations including detecting that the pump is cavitating or in a dry state based on the feedback signal and controlling one or more operations of the appliance when it is detected that the pump is cavitating or in the dry state.

Another aspect of the present disclosure is directed to an appliance. The appliance includes a control unit that includes a processor and a memory. The appliance also includes a pump that includes a three-phase motor. The appliance includes an inverter for providing three-phase power to the three-phase motor and a motor speed detection circuit configured to provide a motor speed signal describing a speed of the three-phase motor. The control unit is configured to perform operations including detecting that the pump is cavitating or in a dry state based on the motor speed signal and controlling one or more operations of the appliance when it is detected that the pump is cavitating or in the dry state.

Another aspect of the present disclosure is directed to a method for detecting operation of a pump of a dishwasher in a dry state or a cavitating state. The method includes providing the pump in the dishwasher. The pump includes a three-phase motor. The method includes providing an inverter configured to drive the three-phase motor. The method includes monitoring a feedback signal describing a current used by the inverter to drive the three-phase motor and monitoring a motor speed signal describing a rotational speed of the three-phase motor. The method includes calculating a variance of the rotational speed of the three-phase motor over time based on the motor speed signal and obtaining a detection value and a detection variance. The method includes detecting when the feedback signal is less than the detection value and the calculated variance is greater than the detection variance. The method includes discontinuing operation of the pump upon detecting that the feedback signal is less than the detection value and the calculated variance is greater than the detection variance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
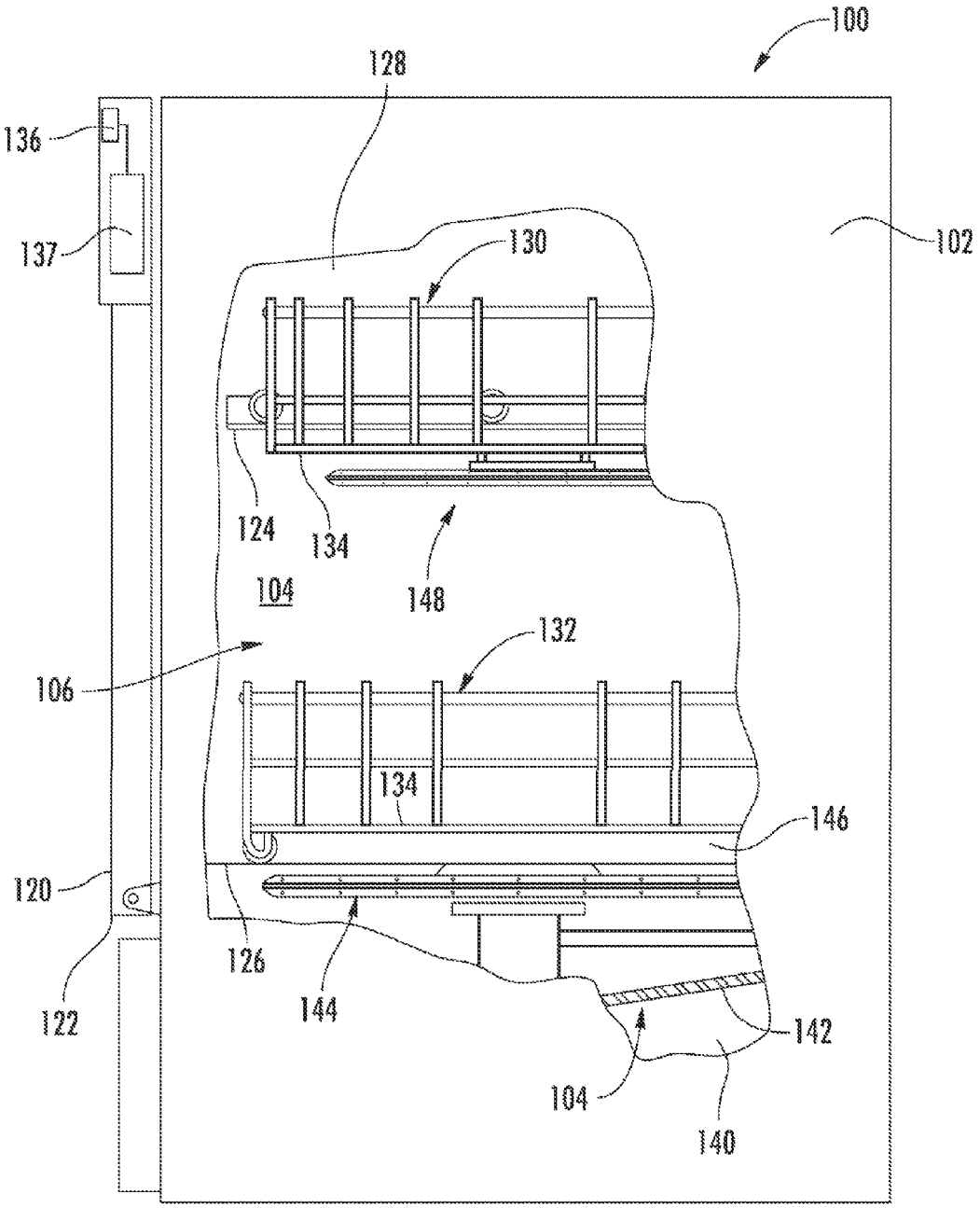
FIG. 1 depicts an exemplary dishwasher according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure is directed to systems and methods for detecting pump cavitation and dry state based on pump motor performance characteristics.

In particular, one embodiment of the present disclosure can include a current measurement circuit configured to provide a feedback signal that describes an inverter current drawn across a DC bus by an inverter providing three-phase power to the pump motor. A control unit of an appliance can detect pump cavitation and dry state by monitoring the feedback signal. For example, when either the value of the feedback signal drops below a detection value or a variance of the feedback signal over time rises above a detection variance, the control unit can detect pump dry state and operate the appliance accordingly.

Another embodiment of the present disclosure can include a motor speed detection circuit configured to provide a motor speed signal describing the speed of the pump motor. The control unit of the appliance can monitor the pump motor speed to detect pump dry state or cavitation. In particular, when a variance of the pump motor speed spikes or otherwise rises above a detection value, the control unit can detect pump dry state or cavitation and respond accordingly. In such fashion, energy and noise levels can be reduced while user safety is increased.

With reference now to the FIGS., exemplary embodiments of the present disclosure will now be discussed in detail. FIG. 1 depicts an exemplary dishwasher 100 according to an exemplary embodiment of the present disclosure. However, it should be understood that the systems and methods disclosed herein are not limited to use with dishwashers and may be used with other appliances such as, for example, washing machines.

Briefly, the dishwasher 100 can include a cabinet 102 having a tub 104 therein that defines a wash chamber 106. The tub 104 can include a front opening (not shown in FIG. 1) and a door 120 hinged at its bottom 122 for movement between a normally closed vertical position wherein the wash chamber 106 is sealed shut for washing operation, and a horizontal open position for loading and unloading of dishwasher contents. Upper and lower guide rails 124, 126 can be mounted on tub side walls 128 and can accommodate upper and lower roller-equipped rack assemblies 130, 132, respectively.

A lower spray-arm-assembly 144 can be rotatably mounted within a lower region 146 of the wash chamber 106 and above tub sump portion 142 so as to rotate in relatively close proximity to the lower rack assembly 132. A mid-level spray-arm assembly 148 can be located in an upper region of the wash chamber 106 and can be located in close proximity to the upper rack 130 and at a sufficient height above lower rack 132 to accommodate larger items, such as a dish or platter. In a further embodiment, an upper spray assembly can be located above the upper rack assembly 130 at a sufficient height to accommodate taller items in the upper rack assembly 130.

The lower and mid-level spray-arm assemblies 144, 148 and the upper spray arm assembly can be fed by a fluid circulation assembly for circulating water and dishwasher fluid in the tub 104. The fluid circulation assembly can be located in a machinery compartment 140 located below the bottom sump portion 142 of the tub 104, as generally recognized in the art.

Operation of the dishwasher 100 can be regulated by a control unit 137 which is operatively coupled to a user interface or input 136 for user manipulation to select dishwasher machine cycles and features. In response to user manipulation of the user interface 136, the control unit 137 can operate the various components of the dishwasher 100 and executes selected machine cycles and features.

In one embodiment, the user interface 136 cab represent a general purpose PO ("GPIO") device or functional block. In another embodiment, the user interface 136 can include input components, such as one or more of a variety of electrical, mechanical or electro-mechanical input devices including rotary dials, push buttons, and touch pads. The user interface 136 can include a display component, such as a digital or analog display device designed to provide operational feedback to a user.

The control unit 137 can be positioned in a variety of locations throughout dishwasher 100. In the illustrated embodiment, the control unit 137 is located within a control panel area of door 120 as shown. In such an embodiment, input/output ("I/O") signals can be routed between the control system and various operational components of dishwasher 100 along wiring harnesses that can be routed through the bottom 122 of door 120.

Again, it should be appreciated that the method disclosed herein is not limited to any particular style, model, or other configuration of dishwasher, and that the embodiment depicted in FIG. 1 is for illustrative purposes only. Further, the present disclosure is not specifically limited to dishwashers, but can be implemented with respect to other appliances as well, including washing machines.

Figure 2:
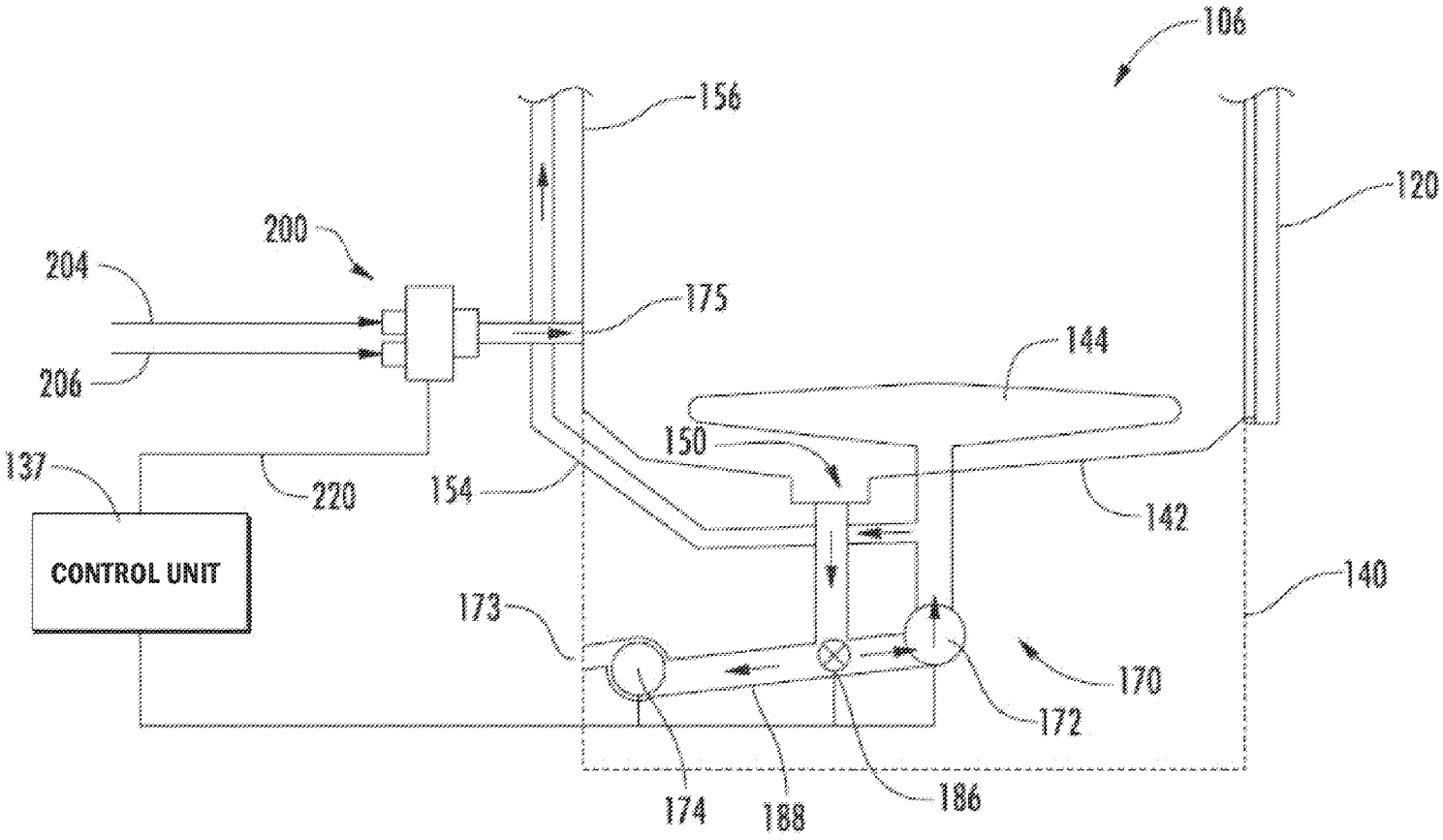
FIG. 2 depicts an exemplary fluid circulation assembly according to an exemplary embodiment of the present disclosure.

FIG. 2 depicts an exemplary fluid circulation assembly 170 of the exemplary dishwasher of FIG. 1 according to an exemplary embodiment of the present disclosure. Although one exemplary embodiment of fluid circulation assembly 170 operable in accordance with aspects of the disclosure is shown, it is contemplated that other fluid circulation assembly configurations may similarly be utilized without departing from the spirit and scope of the invention.

Fluid circulation assembly 170 can include a wash pump assembly 172 and a drain pump assembly 174, both in fluid communication with sump 150. Additionally, drain pump assembly 174 can be in fluid communication with an external drain 173 to discharge used wash liquid, e.g., to a sewer or septic system (not shown). Further, wash pump assembly 172 can be in fluid communication with lower spray arm assembly 144 and conduit 154 which extends to a back wall 156 of wash chamber 106, and upward along back wall 156 for feeding wash liquid to mid-level spray arm assembly 148 (FIG. 1) and the upper spray arm assembly. This configuration also applies to a drawer-type of dishwasher, as mentioned above.

As wash liquid is pumped through lower spray arm assembly 144, and further delivered to mid-level spray arm assembly 148 and the upper spray arm assembly (not shown), washing sprays can be generated in wash chamber 106, and wash liquid can collect in sump 150. Sump 150 can include a cover to prevent larger objects from entering sump 150, such as a piece of silverware or another dishwasher item that is dropped beneath lower rack 132. A coarse filter and a fine filter (not shown) can be located adjacent sump 150 to filter wash liquid for sediment and particles of predetermined sizes before flowing into sump 150. Sump 150 can be filled with water through an inlet port 175 which outlets into wash chamber 106, as described in greater detail below.

A water supply 200 can be configured with inlet port 175 for supplying wash liquid to wash chamber 106. Water supply 200 can provide hot water only, cold water only, or either selectively as desired. As depicted, water supply 200 can have a hot water input 204 that receives hot water from an external source, such as a hot water heater and a cold water input 206 that receives cold water from an external source. It should be understood that the term "water supply" is used herein to encompass any manner or combination of valves, lines or tubing, housing, and the like, and may simply comprise a conventional hot or cold water connection.

As shown in FIG. 2, a drain valve 186 can be established in flow communication with sump 150 and can open or close flow communication between sump 150 and a drain pump inlet 188. Drain pump assembly 174 can be in flow communication with drain pump inlet 188 and can include an electric motor for pumping fluid at inlet 188 to an external drain system via drain 173. In one embodiment, when drain pump assembly 174 is energized, a negative pressure can be created in drain pump inlet 188 and drain valve 186 is opened, allowing fluid in sump 150 to flow into fluid pump inlet 188 and be discharged from fluid circulation assembly 170 via external drain 173.

Alternatively, drain and wash pump assemblies 172 and 174 can be connected directly to the side or the bottom of sump 150, and drain and wash pump assemblies 172, 174 can each include their own valving replacing drain valve 186. Other fluid circulation systems are possible as well, drawing fluid from sump 150 and providing fluid as desired within wash chamber 106 or draining fluid out of washing machine 100.

In addition, fluid circulation assembly 170 can include one or more heating elements for heating water within the dishwasher. Generally, the heating elements can be used to heat water for use by wash pump assembly 172 for one or more wash or rinse cycles in which the contents of the dishwasher are subjected to the heated water. In particular, in some embodiments, the one or more heating elements can be included internally within wash pump assembly 172.

As shown in FIG. 2, control unit 137 can communicate with or control the operation of wash pump assembly 172, drain pump assembly 174, drain valve 186, and water supply 200.

Figure 3:
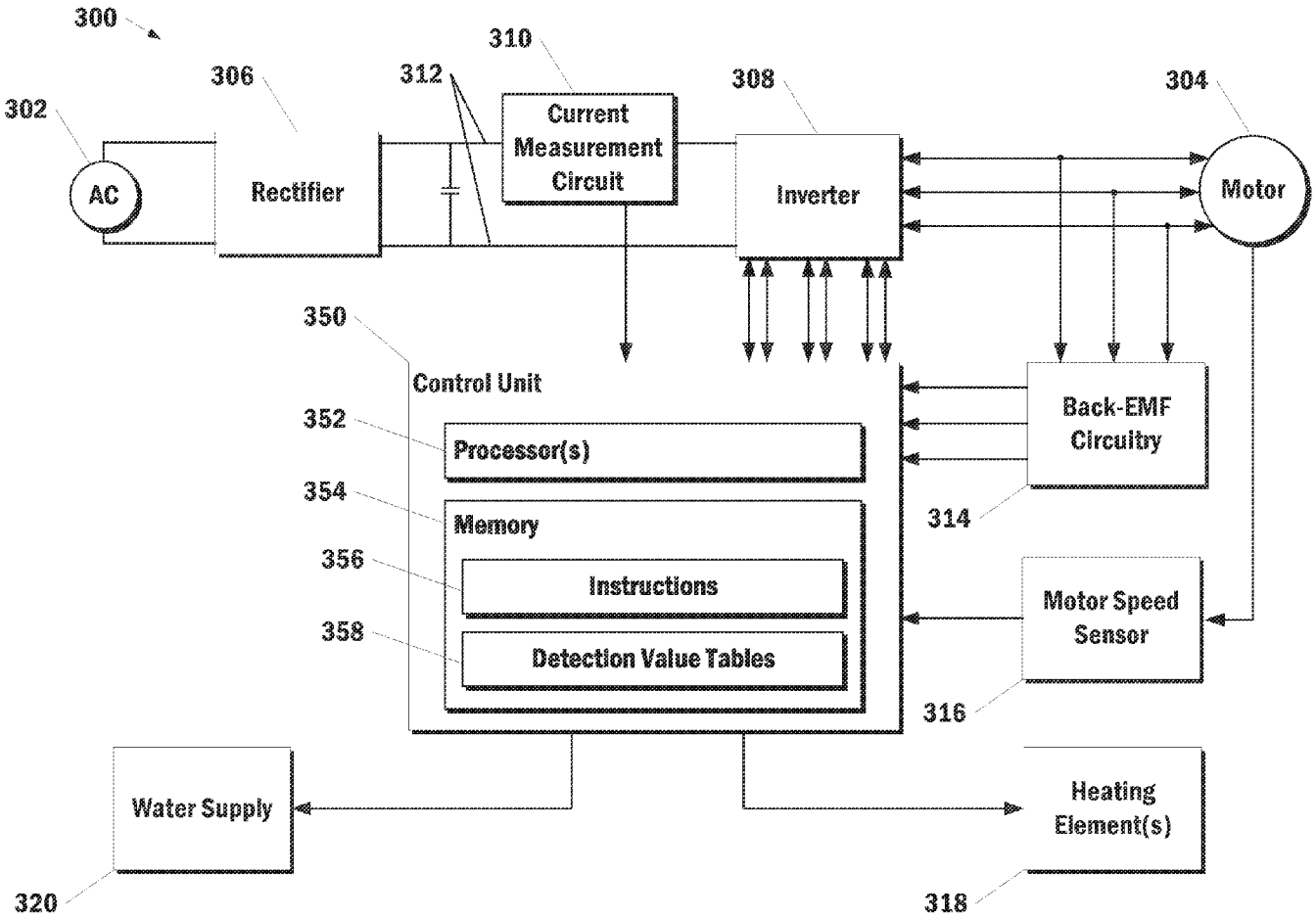
FIG. 3 depicts a block diagram view of an exemplary appliance control system according to an exemplary embodiment of the present disclosure.

FIG. 3 depicts a block diagram view of an exemplary appliance control system 300 according to an exemplary embodiment of the present disclosure. Appliance control system 300 can include an AC power connection 302, a motor 304, a rectifier 306, and an inverter 308. AC power connection 302 can receive AC line power generated by a utility that exhibits defined frequency and voltage characteristics. AC power from AC power connector 302 can be converted into DC power by rectifier 306. Such DC power can be carried on a DC bus 312.

Inverter 308 can transform the DC power into three-phase power to drive motor 304. In particular, inverter 308 can include a plurality of switching elements and gate drivers that can be manipulated to transform the DC power into three-phase power based on pulse width modulation (PWM) control signals provided by control unit 350. For example, inverter 308 can include three pairs of switching elements, each pair having a high-side switching element and a low-side switching element. The three pairs of switching elements can be configured in a traditional three-phase inverter bridge configuration. One of skill in the art will understand the operation of inverter 308 according to PWM control methods and, therefore, the detailed operation of inverter 308 will not be discussed here. However, it will be appreciated that inverter 308 can be controlled to drive motor 304 at varying speeds and according to various control methods, including, but not limited to, back electromotive force sensorless control, field oriented control, closed loop control, or other suitable control methods.

According to an aspect of the present disclosure, appliance control system 300 can further include a current measurement circuit 310. Current measurement circuit 310 can be configured to provide a feedback signal that describes a current drawn or otherwise used by inverter 308 to drive motor 304. Current measurement circuit 310 can include any suitable components for providing the feedback signal. In one implementation, current measurement circuit includes a shunt resistor positioned in the path of current flow across DC bus 312 and an operational amplifier configured to amplify the voltage across the shunt resistor. However, one of skill in the art will appreciate that many different configurations can be used to provide a feedback signal describing a current drawn or used by inverter 308. Any of such configurations can be used to satisfy the present disclosure.

Further, although current measurement circuit 310 is depicted in FIG. 3 as being positioned at the portion of DC bus 312 that carries positive DC power to inverter 308, the present disclosure is not limited to such positioning. For example, current measurement circuit 310 can be positioned at the portion of DC bus 312 that carries current out of or away from inverter 308. As another example, current measurement circuit 310 can be positioned internally to or on the same board with inverter 308. Generally, current measurement circuit 310 can include any position or configuration that provides a suitable feedback signal describing the current drawn or used by inverter 308 to drive motor 304.

Motor 304 can be any suitable form of three-phase motor, including a three-phase induction motor, a three-phase synchronous motor, or other suitable types of motors. Motor 304 can be included as a component of a pump assembly, including, for example, either wash pump assembly 172 or drain pump assembly 174 of FIG. 2. Thus, while only a single pair of inverter and motor are depicted in FIG. 3, it will be appreciated that appliance control system 300 can include two or more inverters respectively associated with two or more motors. Each of such motors can be independently controlled by control unit 350. Likewise, a current measurement circuit 310 and motor speed sensing circuitry 314 and 316 can be provided for each inverter and motor.

Control unit 350 can include one or more processor(s) 352, a memory 354, and any other suitable components. The processor(s) 352 can be any suitable processing device, such as a microprocessor, microcontroller, integrated circuit, or other suitable processing device. The memory 354 can include any suitable computing system or media, including, but not limited to, non-transitory computer-readable media, RAM, ROM, hard drives, flash drives, or other memory devices. While FIG. 3 depicts control unit 350 as a single component, it will be appreciated that processor(s) 352 and memory 354 are not required to be positioned together or within any particular distance of each other.

The memory 354 can store information accessible by processor(s) 352, including instructions 356 that can be executed by processor(s) 352. The instructions 356 can be any set of instructions that when executed by the processor (s) 352, cause the processor(s) 352 to provide desired functionality, such as implementing aspects of the present disclosure. As will be discussed further later, memory 354 can further include one or more tables storing or providing detection values or detection variances. In one implementation, the tables 358 store detection values and detection variances indexed by a target speed of motor 304 and are generated and stored in memory 354 at the time of manufacture.

Appliance control system 300 can further include back-EMF circuitry 314. Back-EMF circuitry 314 can measure, sample, condition, or otherwise provide signals describing back electromotive force generated by motor 304. Back-EMF circuitry 314 can work in concert with control unit 350 to determine a present speed of motor 304 based on such signals describing back electromotive force. For example, in one implementation, back-EMF circuitry 314 provides control unit 350 a plurality of signals describing voltages across fixed value resistors included in back-EMF circuitry 314 at respective zero-crossings of the three-phase driving power. Generally, such voltages are proportional to motor speed. However, any suitable method or configuration for determining motor speed based on back electromotive force can be used to satisfy element 314, as is known in the art.

Alternatively or additionally to back-EMF circuitry 314, appliance control system 300 can further include a motor speed sensor 316. Motor speed sensor 316 can be any known configuration of components or device for sensing a present speed of motor 304 and providing such information to control unit 350. For example, motor speed sensor 316 can include a magnetometer or an optical sensor to determine present speed of motor 304.

As shown in FIG. 3, control unit 350 can further be in communication with or control a water supply 320 and one or more heating element(s) 318. For example, water supply 320 can be used to introduce additional water from an external source into a water circulation system. Heating element(s) 318 can be used to heat water or other liquid in the water circulation system for one or more rinse or wash cycles. In one implementation, heating element(s) 318 and motor 304 are both included internally within a wash pump assembly, such as wash pump assembly 172 of FIG. 2.

Figure 4:
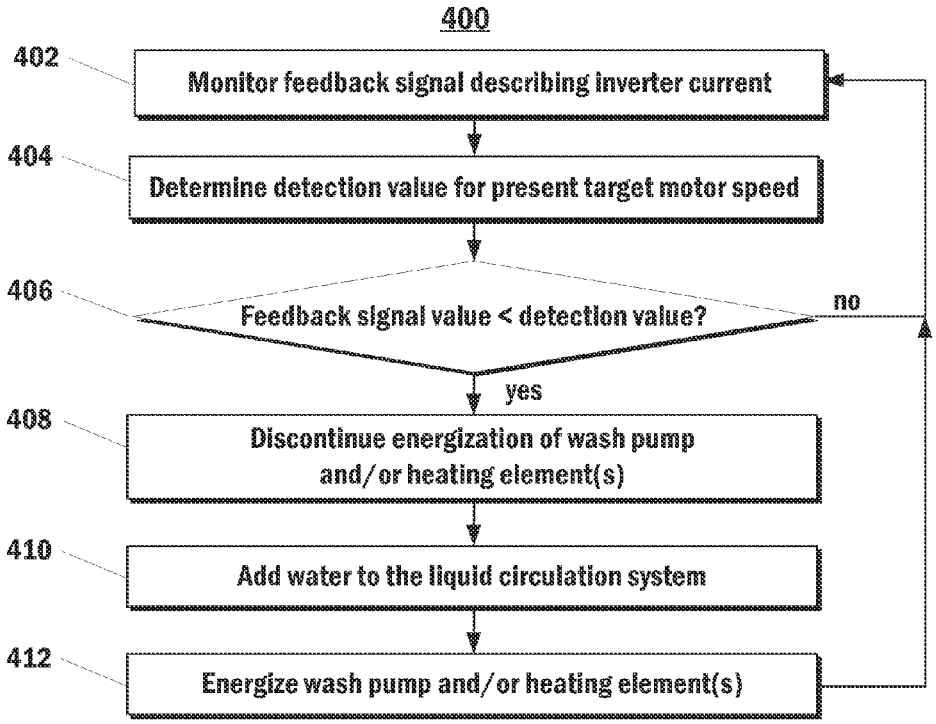
FIG. 4 depicts a flow chart of an exemplary method for operating a wash pump according to an exemplary embodiment of the present disclosure.

FIG. 4 depicts a flow chart of an exemplary method (400) for operating a wash pump according to an exemplary embodiment of the present disclosure. While method (400) will be discussed with reference to appliance control system 300 of FIG. 3, method (400) can be implemented using any suitable appliance control system.

In addition, the flowchart for each of the methods disclosed herein depicts steps performed in a particular order for purposes of illustration and discussion. Those of ordinary skill in the art, using the disclosures provided herein, will understand that the various steps of any of the methods disclosed herein can be omitted, adapted, rearranged in various ways, and/or supplemented by additional steps.

At (402) a feedback signal that describes inverter current can be monitored. For example, current measurement circuit 310 can provide a feedback signal to control unit 350 that describes an inverter current drawn or used by inverter 308 to drive a wash pump motor 304.

Figure 6:
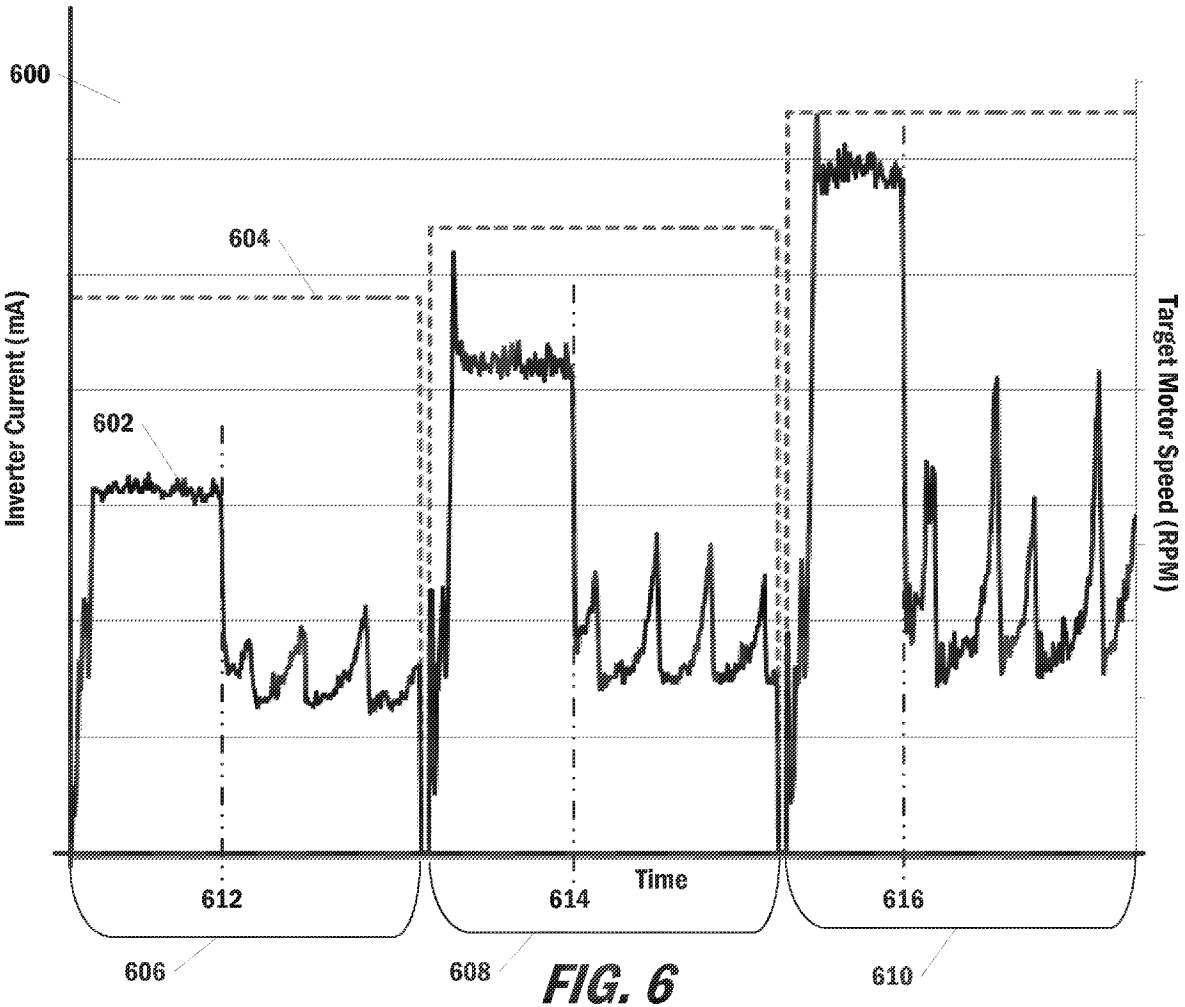
FIG. 6 depicts a graphical representation of inverter current and target motor speed over time according to an exemplary embodiment of the present disclosure.

As an example, FIG. 6 depicts a graphical representation 600 of inverter current 602 and target motor speed 604 over time according to an exemplary embodiment of the present disclosure. More particularly, inverter current 602 shows inverter current magnitude as a pump is successively driven from a wet state to a dry state three times over three time periods 606, 608, and 610 at three different target motor speeds. It will be appreciated that inverter current 602 and target motor speed 604 are displayed in heterogeneous units and therefore are simply shown side by side for purposes of explanation.

As can be seen from FIG. 6, for each instance in which the pump transitions from a wet state to a dry state or cavitation, inverter current 602 demonstrates a detectable reduction in magnitude. For example, during time period 606 the pump transitions from a wet state to a dry state or cavitation at time 612. Thus, a corresponding reduction in inverter current 602 can be seen at time 612. The same occurs phenomenon occurs at times 614 and 616.

As can also be seen from FIG. 6, there is a ramp up period for inverter current 602 for each instance in which the motor is driven from a stopped position to meet a new target motor speed. Therefore, method (400) can include waiting for a predefined time lag after energizing the pump motor prior to monitoring inverter current 602 at (402) or prior to performing other steps of method (400). It will be appreciated that such time lag can be applied to all other operating methods disclosed herein, as well.

Figure 7:
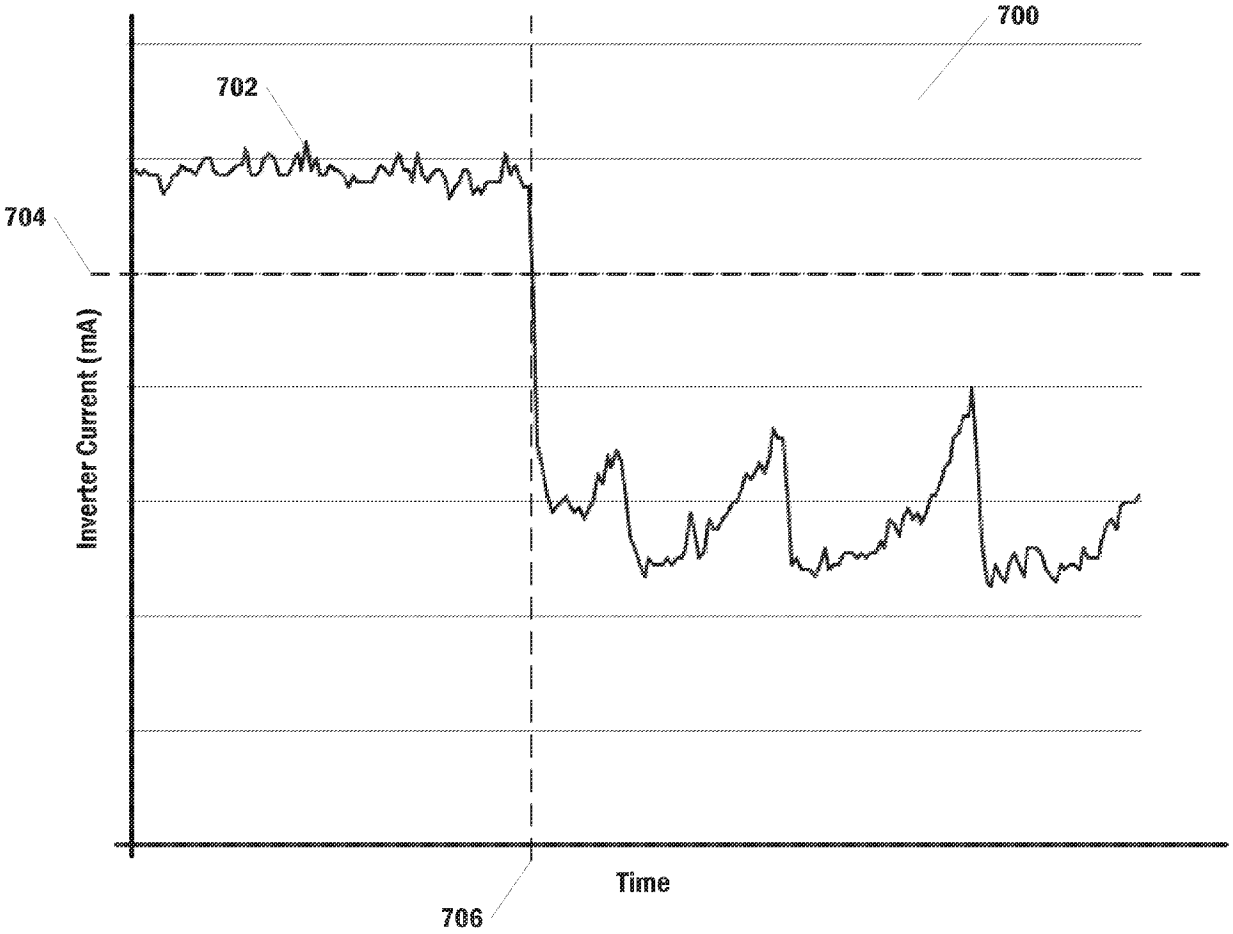
FIG. 7 depicts a graphical representation of inverter current over time according to an exemplary embodiment of the present disclosure.

As another example, FIG. 7 depicts a graphical representation 700 of inverter current 702 over time according to an exemplary embodiment of the present disclosure. In particular, FIG. 7 shows inverter current 702 as a pump is driven at a single target motor speed and after an initial ramp up period. At time 706 the pump transitions from a wet state into a dry state or cavitation. A corresponding reduction in the magnitude of inverter current 702 can also be seen at time 706.

Returning to FIG. 4, at (404) a detection value can be determined for the present target motor speed. For example, processor(s) 352 can access detection value tables 358 to obtain the detection value for the present target motor speed.

At (406) it can be determined whether the present feedback signal value is less than the detection value determined at (404). For example, processor(s) 352 can compare the most recent value of the feedback signal with the detection value. For example, with reference to FIG. 7, also depicted on graphical representation 700 is an exemplary detection value 704. As can be seen, while the pump is operating in a wet state prior to time 706, inverter current 702 is greater than detection value 704. However, after time 706 when the pump is operating in a dry state or experiencing cavitation, inverter current 702 is less than detection value 704.

Thus, if it is determined at (406) that the feedback signal is greater than the detection value, then the appliance control system can assume that the pump is properly operating in a wet state and method (400) can return to (402) and continue monitoring the feedback signal.

However, if it is determined at (406) that the feedback signal value is less than the detection value, then the appliance control system can assume that the pump is either operating in a dry state or is experiencing cavitation. Therefore, if it is determined at (406) that the feedback signal value is less than the detection value obtained at (404), then method (400) can advance to (408).

At (408) energization of the wash pump and or the heating element(s) can be discontinued. For example, control unit 350 can control inverter 308 to discontinue energization of motor 304. Alternatively or additionally, control unit 350 can discontinue energization of heating element(s) 318. In such fashion, the extraneous noise associated with dry state pump operation and/or safety concerns about the overheating of the heating element(s) can be eliminated.

At (410) water can be added to the liquid circulation system. For example, control unit 350 can control water supply 320 to add water to the liquid circulation system such that the wash pump is fully primed and returns to a wet state.

At (412) the wash pump and/or the heating element(s) can be reenergized and the washing operations can be resumed. Method (400) can then return to (402) and continue to monitor the feedback signal. In such fashion, pump operation during dry state or during cavitation can quickly be recognized, sound or safety issues can be resolved, the pump can be returned to a wet state, and normal operation can be continued.

Figure 5:
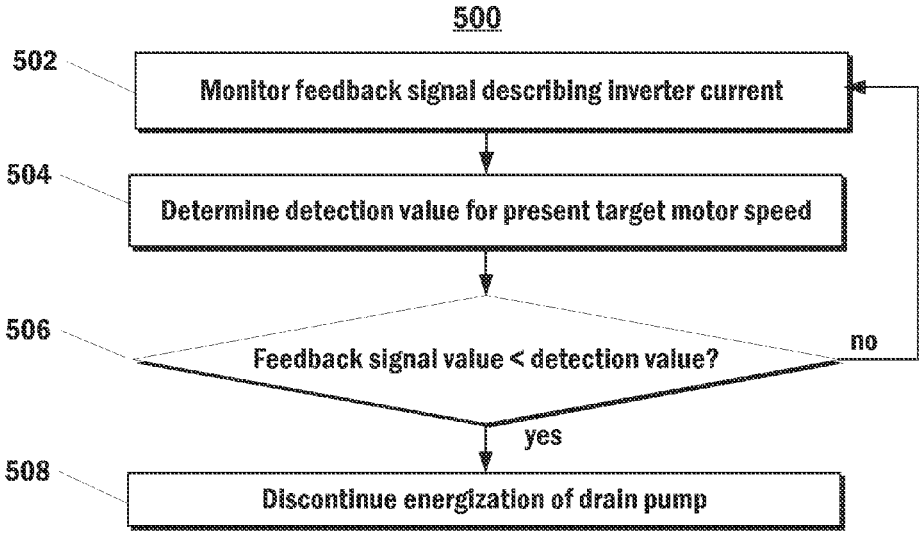
FIG. 5 depicts a flow chart of an exemplary method for operating a drain pump according to an exemplary embodiment of the present disclosure.

FIG. 5 depicts a flow chart of an exemplary method (500) for operating a drain pump according to an exemplary embodiment of the present disclosure. While method (500) will be discussed with reference to appliance control system 300 of FIG. 3, method (500) can be implemented using any suitable appliance control system.

At (502) a feedback signal that describes inverter current can be monitored. For example, current measurement circuit 310 can provide a feedback signal to control unit 350 that describes an inverter current drawn or used by inverter 308 to drive a drain pump motor 304.

At (504) a detection value can be determined for the present target motor speed. For example, processor(s) 352 can access detection value tables 358 to obtain the detection value for the present target motor speed.

At (506) it can be determined whether the feedback signal value is less than the detection value obtained at (504). If it is determined at (506) that the feedback signal is greater than the detection value, then the appliance control system can assume that the drain pump is still operating in a wet state and method (500) can return to (502) and continue monitoring the feedback signal.

However, if it is determined at (506) that the feedback signal value is less than the detection value, then the appliance control system can assume that the drain pump is either operating in a dry state or is experiencing cavitation. Therefore, if it is determined at (506) that the feedback signal value is less than the detection value obtained at (504), then method (500) can advance to (508).

At (508) energization of the drain pump can be discontinued. In particular, if the drain pump is operating in a dry state, then it can be assumed that the liquid was properly drained from the sump. Thus, control unit 350 can control inverter 308 to discontinue energization of a drain pump motor 304 at (508). In such fashion, energization of the drain pump is discontinued as soon as the drain pump has properly drained the liquid from the sump and enters the dry state. Therefore, unnecessary noise and energy consumption are both reduced.

Figure 8:
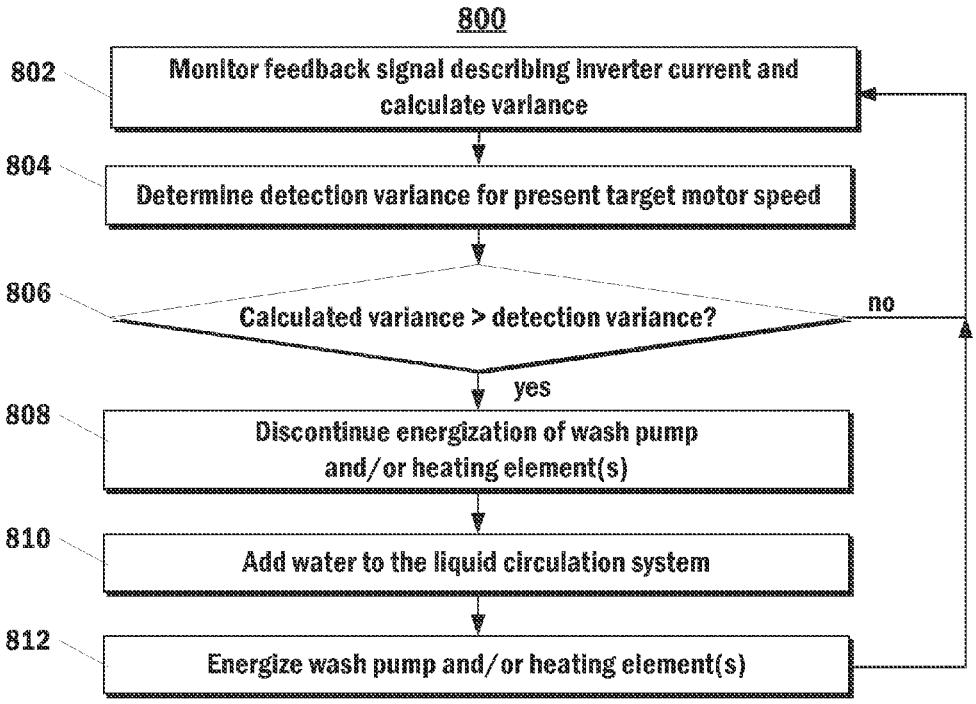
FIG. 8 depicts a flow chart of an exemplary method for operating a wash pump according to an exemplary embodiment of the present disclosure.

FIG. 8 depicts a flow chart of an exemplary method (800) for operating a wash pump according to an exemplary embodiment of the present disclosure. While method (800) will be discussed with reference to appliance control system 300 of FIG. 3, method (800) can be implemented using any suitable appliance control system.

At (802) a feedback signal that describes inverter current can be monitored. For example, current measurement circuit 310 can provide a feedback signal to control unit 350 that describes an inverter current drawn or used by inverter 308 to drive a wash pump motor 304.

Furthermore, at (802) a variance of the feedback signal can be calculated. For example, a moving average of a number of samples of the feedback signal can be calculated periodically. At each period the most recent sample of the feedback signal can be compared with the moving average to determine the variance of the feedback signal. However, other methods for calculating a variance can be used to satisfy (802) and the present disclosure, including analyzing a number of samples over a time window to determine a maximum and a minimum or calculating one or more integrals or derivatives of the feedback signal.

As an example, FIG. 7 shows inverter current 702 as a pump is driven at a single target motor speed and after an initial ramp up period. At time 706 the pump transitions from a wet state into a dry state or cavitation. As can be seen in FIG. 7, when the pump transitions from a wet state into a dry state or cavitation, the inverter current 702 experiences an increase in variance. In particular, when the pump is operating in a wet state prior to time 706, inverter current 702 shows relatively little variance. In other words, the current values are generally grouped closely around a single value. However, after time 706 when the pump is operating in a dry state or experiencing cavitation, inverter current 702 shows a relatively greater variance. In other words, relatively large increases and decreases in inverter current 702 can be seen after time 706.

Returning to FIG. 8, at (804) a detection variance can be determined for the present target motor speed. For example, processor(s) 352 can access detection value tables 358 to obtain the detection variance for the present target motor speed.

At (806) it can be determined whether the variance calculated at (802) is greater than the detection variance determined at (804). For example, processor(s) 352 can compare the calculated variance with the detection variance.

If it is determined at (806) that the calculated variance is less than the detection variance, then the appliance control system can assume that the pump is properly operating in a wet state and method (800) can return to (802) and continue monitoring the feedback signal and calculating feedback signal variance.

However, if it is determined at (806) that the calculated variance is greater than the detection variance, then the appliance control system can assume that the pump is either operating in a dry state or is experiencing cavitation. Therefore, if it is determined at (806) that the calculated variance is greater than the detection variance obtained at (804), then method (800) can advance to (808).

At (808) energization of the wash pump and or the heating element(s) can be discontinued. For example, control unit 350 can control inverter 308 to discontinue energization of motor 304. Alternatively or additionally, control unit 350 can discontinue energization of heating element(s) 318. In such fashion, the extraneous noise associated with dry state pump operation and/or safety concerns about the overheating of the heating element(s) can be eliminated.

At (810) water can be added to the liquid circulation system. For example, control unit 350 can control water supply 320 to add water to the liquid circulation system such that the wash pump is fully primed and returns to a wet state.

At (812) the wash pump and/or the heating element(s) can be reenergized and the washing operations can be resumed. Method (800) can then return to (802) and continue to monitor the feedback signal. In such fashion, pump operation during dry state or during cavitation can quickly be recognized, sound or safety issues can be resolved, the pump can be returned to a wet state, and normal operation can be continued.

Figure 9:
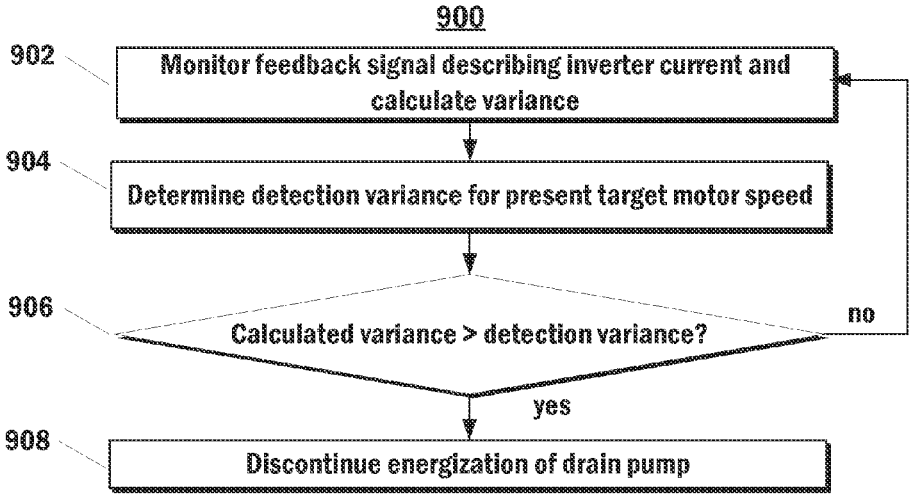
FIG. 9 depicts a flow chart of an exemplary method for operating a drain pump according to an exemplary embodiment of the present disclosure.

FIG. 9 depicts a flow chart of an exemplary method (900) for operating a drain pump according to an exemplary embodiment of the present disclosure. While method (900) will be discussed with reference to appliance control system 300 of FIG. 3, method (900) can be implemented using any suitable appliance control system.

At (902) a feedback signal that describes inverter current can be monitored. For example, current measurement circuit 310 can provide a feedback signal to control unit 350 that describes an inverter current drawn or used by inverter 308 to drive a wash pump motor 304.

Furthermore, at (902) a variance of the feedback signal can be calculated. For example, a moving average of a number of samples of the feedback signal can be calculated periodically. At each period the most recent sample of the feedback signal can be compared with the moving average to determine the variance of the feedback signal. However, other methods for calculating a variance can be used to satisfy (902) and the present disclosure.

At (904) a detection variance can be determined for the present target motor speed. For example, processor(s) 352 can access detection value tables 358 to obtain the detection variance for the present target motor speed.

At (906) it can be determined whether the variance calculated at (902) is greater than the detection variance determined at (904). For example, processor(s) 352 can compare the calculated variance with the detection variance.

If it is determined at (906) that the calculated variance is less than the detection variance, then the appliance control system can assume that the drain pump is still operating in a wet state and method (900) can return to (902) and continue monitoring the feedback signal.

However, if it is determined at (906) that the calculated variance is greater than the detection variance, then the appliance control system can assume that the drain pump is either operating in a dry state or is experiencing cavitation. Therefore, if it is determined at (906) that the calculated variance is greater than the detection variance obtained at (904), then method (900) can advance to (908).

At (908) energization of the drain pump can be discontinued. In particular, if the drain pump is operating in a dry state, then it can be assumed that the liquid was properly drained from the sump. Thus, control unit 350 can control inverter 308 to discontinue energization of a drain pump motor 304 at (908). In such fashion, energization of the drain pump is discontinued as soon as the drain pump has properly drained the liquid from the sump and enters the dry state. Therefore, unnecessary noise and energy consumption are both reduced.

Figure 10:
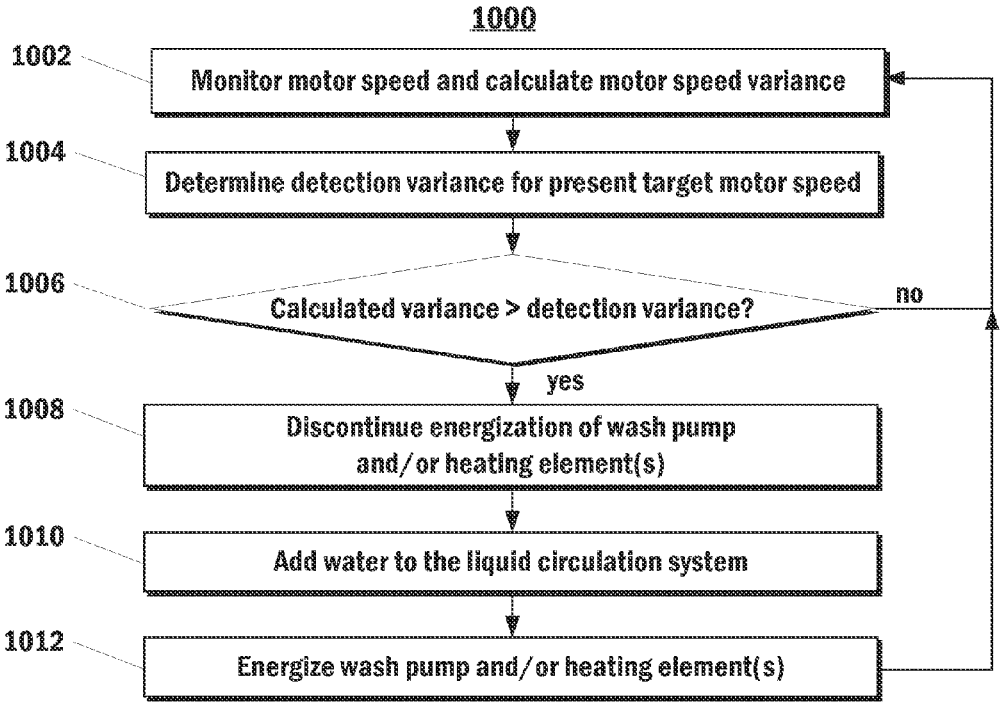
FIG. 10 depicts a flow chart of an exemplary method for operating a wash pump according to an exemplary embodiment of the present disclosure.

FIG. 10 depicts a flow chart of an exemplary method (1000) for operating a wash pump according to an exemplary embodiment of the present disclosure. While method (1000) will be discussed with reference to appliance control system 300 of FIG. 3, method (1000) can be implemented using any suitable appliance control system.

At (1002) a motor speed signal that describes motor speed can be monitored. For example, back-EMF circuitry 314 can provide a motor speed signal to control unit 350 that describes the speed of a wash pump motor 304. As another example, motor speed sensor 316 can provide a motor speed signal to control unit 350 that describes the speed of the wash pump motor 304.

Furthermore, at (1002) a variance of the motor speed can be calculated. For example, a moving average of a number of samples of the motor speed signal can be calculated periodically. At each period the most recent sample of the motor speed signal can be compared with the moving average to determine the variance of the motor speed. However, other methods for calculating a variance can be used to satisfy (1002) and the present disclosure, including analyzing a number of samples over a time window to determine a maximum and a minimum or calculating one or more integrals or derivatives of the motor speed signal.

Figure 12:
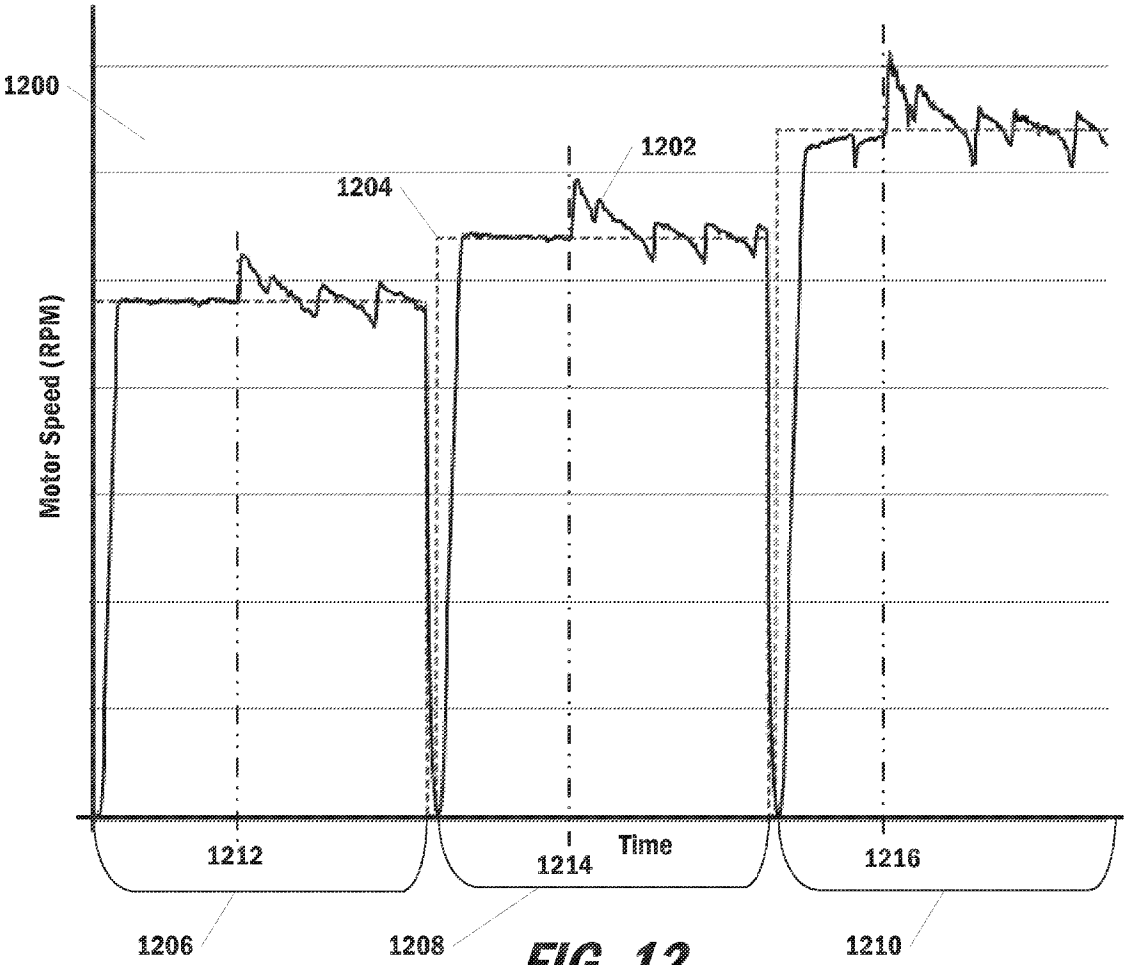
FIG. 12 depicts a graphical representation of pump motor speed and target motor speed over time according to an exemplary embodiment of the present disclosure.

As an example, FIG. 12 depicts a graphical representation 1200 of actual motor speed 1202 and target motor speed 1204 over time according to an exemplary embodiment of the present disclosure. More particularly, motor speed 1202 represents motor speed as a pump is successively driven from a wet state to a dry state three times over three time periods 1206, 1208, and 1210 at three different target motor speeds.

As can be seen from FIG. 12, for each instance in which the pump transitions from a wet state to a dry state or cavitation, motor speed 1202 demonstrates a detectable increase in variance. For example, during time period 1206 the pump transitions from a wet state to a dry state or cavitation at time 1212. Thus, a corresponding increase in variance of motor speed 1202 can be seen at time 1212. The same occurs phenomenon occurs at times 1214 and 1216.

As can also be seen from FIG. 12, there is a ramp up period for motor speed 1202 for each instance in which the motor is driven from a stopped position to meet a new target motor speed. Therefore, method (1000) can include waiting for a predefined time lag after energizing the pump motor prior to calculating the variance in motor speed at (1002) or prior to performing other steps of method (1000).

Figure 13:
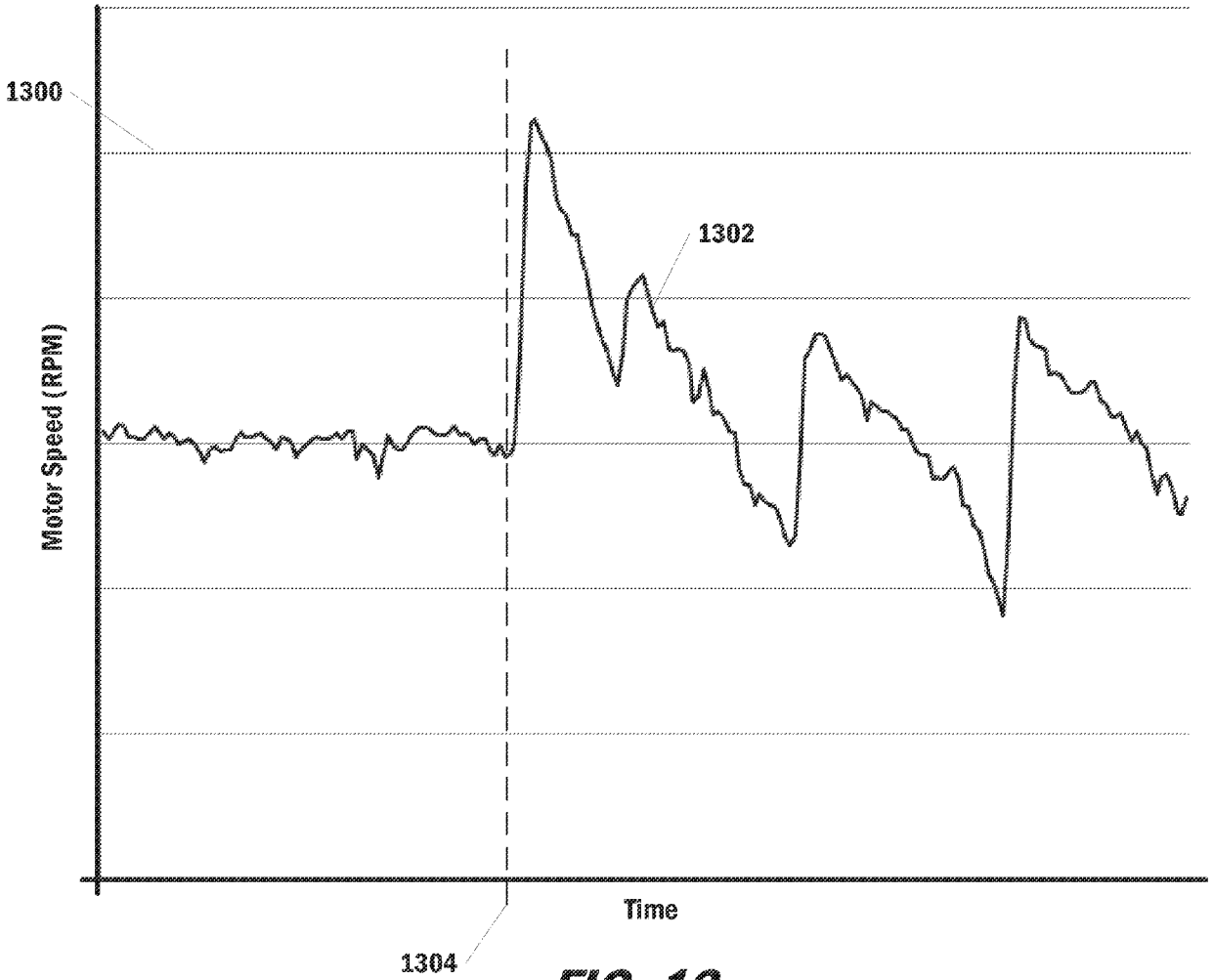
FIG. 13 depicts a graphical representation of pump motor speed over time according to an exemplary embodiment of the present disclosure.

As another example, FIG. 13 depicts a graphical representation 1300 of motor speed 1302 over time according to an exemplary embodiment of the present disclosure. In particular, FIG. 13 shows motor speed 1302 as a pump transitions from a wet state to a dry state at a single target motor speed and after an initial ramp up period. At time 1304 the pump transitions from a wet state into a dry state or cavitation. A corresponding increase in the variance of motor speed 1302 can also be seen at time 1304.

Figure 14:
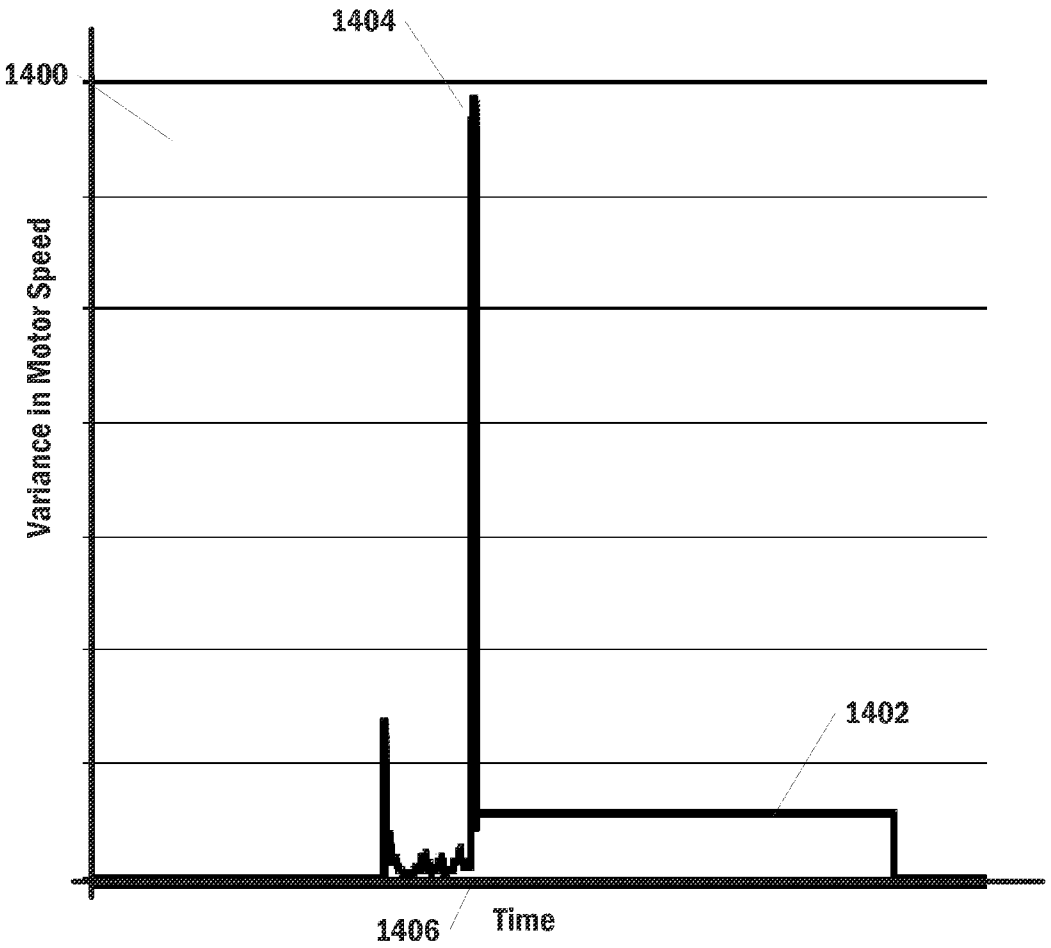
FIG. 14 depicts a graphical representation of variance in pump motor speed over time according to an exemplary embodiment of the present disclosure.

As yet another example, FIG. 14 depicts a graphical representation 1400 of variance 1402 in motor speed over time according to an exemplary embodiment of the present disclosure. In particular, FIG. 14 shows variance 1402 in motor speed as a pump transitions from a wet state to a dry state at a single target motor speed and after an initial ramp up period. At time 1406 the pump transitions from a wet state into a dry state or cavitation. A corresponding detectable increase in the variance 1402 can be seen at time 1406. In particular, a spike 1404 in variance 1402 can be detected at time 1406.

Returning to FIG. 10, at (1004) a detection variance can be determined for the present target motor speed. For example, processor(s) 352 can access detection value tables 358 to obtain the detection variance for the present target motor speed.

At (1006) it can be determined whether variance calculated at (1002) is greater than the detection value determined at (1004). For example, processor(s) 352 can compare the calculated variance with the detection variance.

If it is determined at (1006) that the calculated variance is less than the detection variance, then the appliance control system can assume that the pump is properly operating in a wet state and method (1000) can return to (1002) and continue monitoring the motor speed signal and calculating variance in motor speed.

However, if it is determined at (1006) that the calculated variance is greater than the detection variance, then the appliance control system can assume that the pump is either operating in a dry state or is experiencing cavitation. Therefore, if it is determined at (1006) that the calculated variance is greater than the detection variance obtained at (1004), then method (1000) can advance to (1008).

At (1008) energization of the wash pump and or the heating element(s) can be discontinued. For example, control unit 350 can control inverter 308 to discontinue energization of motor 304. Alternatively or additionally, control unit 350 can discontinue energization of heating element(s) 318. In such fashion, the extraneous noise associated with dry state pump operation and/or safety concerns about the overheating of the heating element(s) can be eliminated.

At (1010) water can be added to the liquid circulation system. For example, control unit 350 can control water supply 320 to add water to the liquid circulation system such that the wash pump is fully primed and returns to a wet state.

At (1012) the wash pump and/or the heating element(s) can be reenergized and the washing operations can be resumed. Method (1000) can then return to (1002) and continue to monitor the motor speed signal. In such fashion, pump operation during dry state or during cavitation can quickly be recognized, sound or safety issues can be resolved, the pump can be returned to a wet state, and normal operation can be continued.

Figure 11:
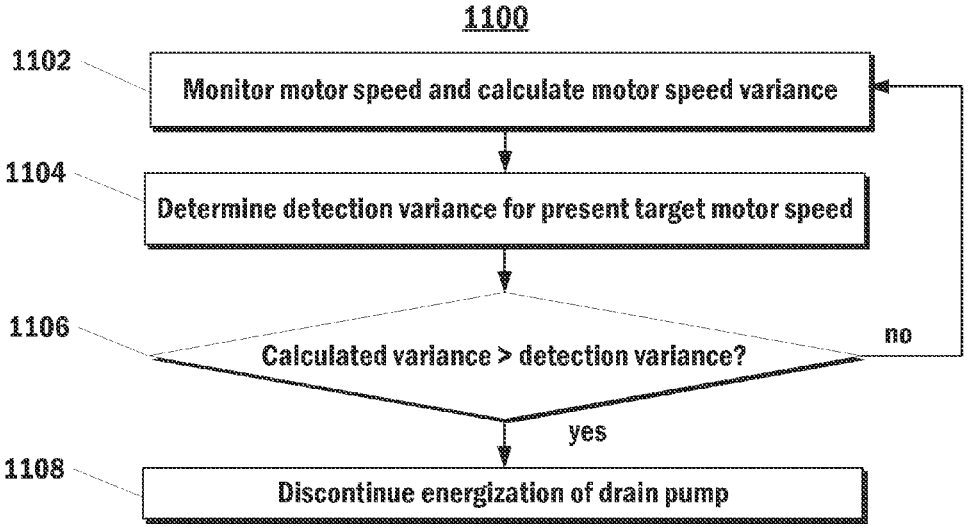
FIG. 11 depicts a flow chart of an exemplary method for operating a drain pump according to an exemplary embodiment of the present disclosure.

FIG. 11 depicts a flow chart of an exemplary method (1100) for operating a drain pump according to an exemplary embodiment of the present disclosure. While method (1100) will be discussed with reference to appliance control system 300 of FIG. 3, method (1100) can be implemented using any suitable appliance control system.

At (1102) a motor speed signal that describes motor speed can be monitored. For example, back-EMF circuitry 314 can provide a motor speed signal to control unit 350 that describes the speed of a wash pump motor 304. As another example, motor speed sensor 316 can provide a motor speed signal to control unit 350 that describes the speed of the wash pump motor 304.

Furthermore, at (1102) a variance of the motor speed can be calculated. For example, a moving average of a number of samples of the motor speed signal can be calculated periodically. At each period the most recent sample of the motor speed signal can be compared with the moving average to determine the variance of the motor speed. However, other methods for calculating a variance can be used to satisfy (1102) and the present disclosure, including analyzing a number of samples over a time window to determine a maximum and a minimum or calculating one or more integrals or derivatives of the motor speed signal.

At (1104) a detection variance can be determined for the present target motor speed. For example, processor(s) 352 can access detection value tables 358 to obtain the detection variance for the present target motor speed.

At (1106) it can be determined whether the variance calculated at (1102) is greater than the detection variance determined at (1104). For example, processor(s) 352 can compare the calculated variance with the detection variance.

If it is determined at (1106) that the calculated variance is less than the detection variance, then the appliance control system can assume that the drain pump is still operating in a wet state and method (1100) can return to (1102) and continue monitoring the motor speed signal and calculating variance in motor speed.

However, if it is determined at (1106) that the calculated variance is greater than the detection variance, then the appliance control system can assume that the drain pump is either operating in a dry state or is experiencing cavitation. Therefore, if it is determined at (1106) that the calculated variance is greater than the detection variance obtained at (1104), then method (1100) can advance to (1108).

At (1108) energization of the drain pump can be discontinued. In particular, if the drain pump is operating in a dry state, then it can be assumed that the liquid was properly drained from the sump. Thus, control unit 350 can control inverter 308 to discontinue energization of a drain pump motor 304 at (1108). In such fashion, energization of the drain pump is discontinued as soon as the drain pump has properly drained the liquid from the sump and enters the dry state. Therefore, unnecessary noise and energy consumption are both reduced.

Figure 15:
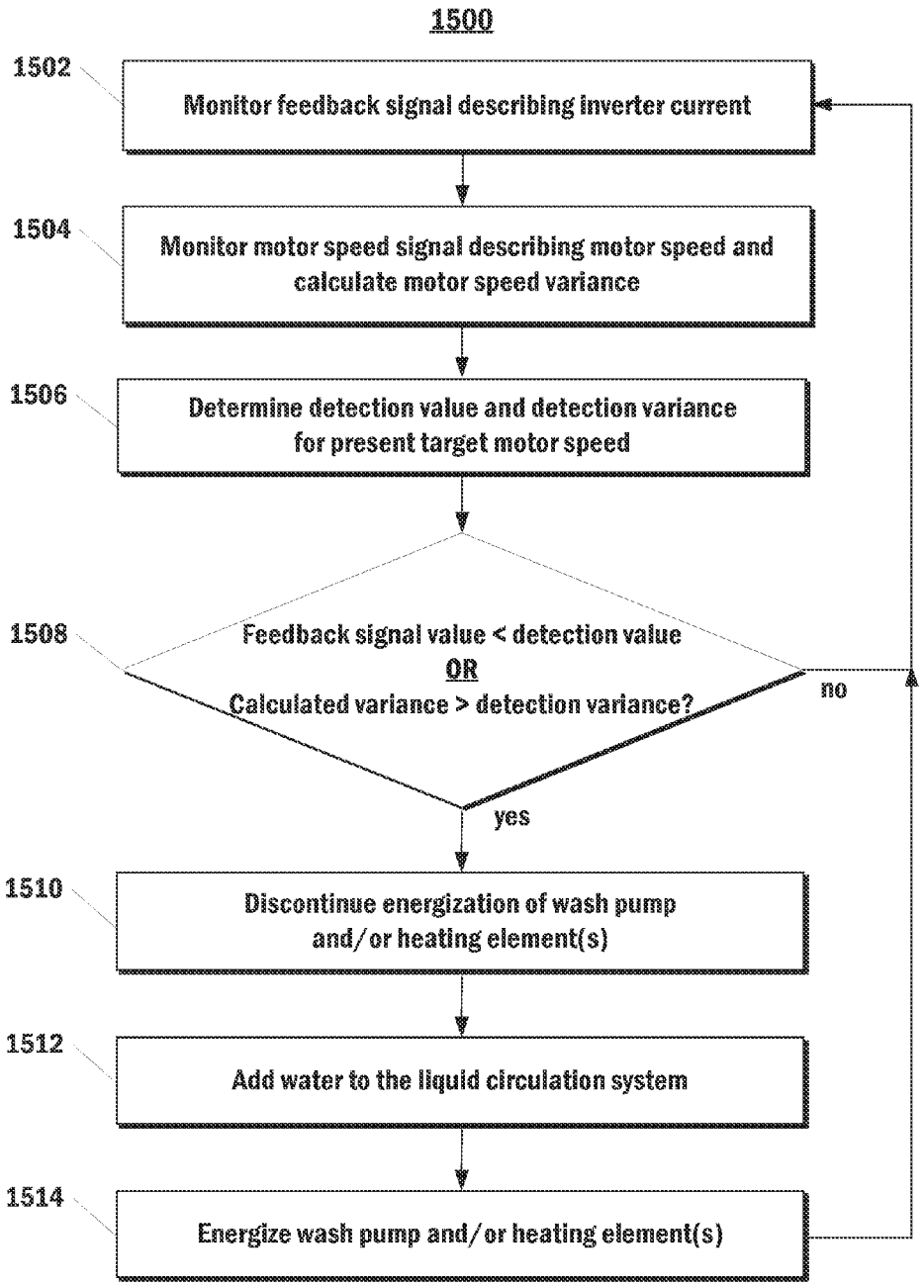
FIG. 15 depicts a flow chart of an exemplary method for detecting operation of a wash pump of a dishwasher in a dry state or a cavitating state.

FIG. 15 depicts a flow chart of an exemplary method (1500) for detecting operation of a wash pump of a dishwasher in a dry state or a cavitating state. While method (1500) will be discussed with reference to appliance control system 300 of FIG. 3, method (1500) can be implemented using any suitable appliance control system.

In addition, the flowchart for each of the methods disclosed herein depicts steps performed in a particular order for purposes of illustration and discussion. Those of ordinary skill in the art, using the disclosures provided herein, will understand that the various steps of any of the methods disclosed herein can be omitted, adapted, rearranged in various ways, and/or supplemented by additional steps.

At (1502) a feedback signal that describes inverter current can be monitored. For example, current measurement circuit 310 can provide a feedback signal to control unit 350 that describes an inverter current drawn or used by inverter 308 to drive a wash pump motor 304.

At (1504) a motor speed signal that describes motor speed can be monitored. For example, back-EMF circuitry 314 can provide a motor speed signal to control unit 350 that describes the speed of a wash pump motor 304. As another example, motor speed sensor 316 can provide a motor speed signal to control unit 350 that describes the speed of the wash pump motor 304.

Furthermore, at (1504) a variance of the motor speed over time can be calculated. For example, a moving average of a number of samples of the motor speed signal can be calculated periodically. At each period the most recent sample of the motor speed signal can be compared with the moving average to determine the variance of the motor speed. However, other methods for calculating a variance can be used to satisfy (1504) and the present disclosure, including analyzing a number of samples over a time window to determine a maximum and a minimum or calculating one or more integrals or derivatives of the motor speed signal.

At (1506) a detection value and a detection variance can be determined for the present target motor speed. For example, processor(s) 352 can access detection value tables 358 to obtain the detection value and detection variance for the present target motor speed.

At (1508) it can be determined whether either the present feedback signal value is less than the detection value determined at (1506) or the calculated variance calculated at (1504) is greater than the detection variance determined at (1506).

If it is determined at (1508) that the feedback signal is greater than the detection value and the calculated variance is less than the detection variance, then the appliance control system can assume that the pump is properly operating in a wet state and method (1500) can return to (1502) and continue monitoring the feedback signal.

However, if it is determined at (1508) that either the feedback signal value is less than the detection value or the calculated variance is greater than the detection variance, then the appliance control system can assume that the pump is either operating in a dry state or is experiencing cavitation. Therefore, method (1500) can advance to (1510).

At (1510) energization of the wash pump and or the heating element(s) can be discontinued. For example, control unit 350 can control inverter 308 to discontinue energization of motor 304. Alternatively or additionally, control unit 350 can discontinue energization of heating element(s) 318. In such fashion, the extraneous noise associated with dry state pump operation and/or safety concerns about the overheating of the heating element(s) can be eliminated.

At (1512) water can be added to the liquid circulation system. For example, control unit 350 can control water supply 320 to add water to the liquid circulation system such that the wash pump is fully primed and returns to a wet state.

At (1514) the wash pump and/or the heating element(s) can be reenergized and the washing operations can be resumed. Method (1500) can then return to (1502). In such fashion, pump operation during dry state or during cavitation can quickly be recognized, sound or safety issues can be resolved, the pump can be returned to a wet state, and normal operation can be continued.

Figure 16:
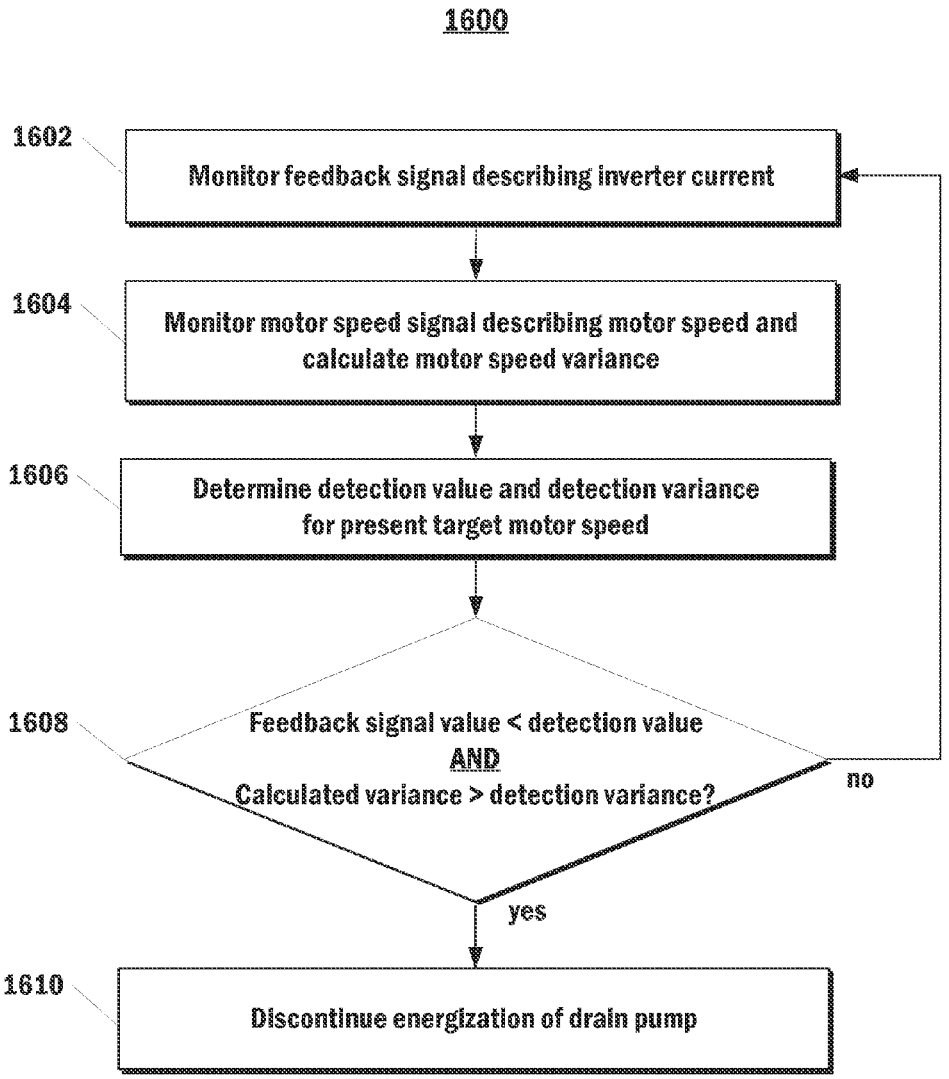
FIG. 16 depicts a flow chart of an exemplary method for detecting operation of a drain pump of a dishwasher in a dry state or a cavitating state.

FIG. 16 depicts a flow chart of an exemplary method (1600) for operating a drain pump according to an exemplary embodiment of the present disclosure. While method (1600) will be discussed with reference to appliance control system 300 of FIG. 3, method (1600) can be implemented using any suitable appliance control system.

At (1602) a feedback signal that describes inverter current can be monitored. For example, current measurement circuit 310 can provide a feedback signal to control unit 350 that describes an inverter current drawn or used by inverter 308 to drive a wash pump motor 304.

At (1604) a motor speed signal that describes motor speed can be monitored. For example, back-EMF circuitry 314 can provide a motor speed signal to control unit 350 that describes the speed of a wash pump motor 304. As another example, motor speed sensor 316 can provide a motor speed signal to control unit 350 that describes the speed of the wash pump motor 304.

Furthermore, at (1604) a variance of the motor speed over time can be calculated. For example, a moving average of a number of samples of the motor speed signal can be calculated periodically. At each period the most recent sample of the motor speed signal can be compared with the moving average to determine the variance of the motor speed. However, other methods for calculating a variance can be used to satisfy (1604) and the present disclosure, including analyzing a number of samples over a time window to determine a maximum and a minimum or calculating one or more integrals or derivatives of the motor speed signal.

At (1606) a detection value and a detection variance can be determined for the present target motor speed. For example, processor(s) 352 can access detection value tables 358 to obtain the detection value and detection variance for the present target motor speed.

At (1608) it can be determined whether both the present feedback signal value is less than the detection value determined at (1606) and the calculated variance calculated at (1604) is greater than the detection variance determined at (1606).

If it is determined at (1608) that either the feedback signal is greater than the detection value or the calculated variance is less than the detection variance, then the appliance control system can assume that the pump is properly operating in a wet state and method (1600) can return to (1602) and continue monitoring the feedback signal.

However, if it is determined at (1608) that both the feedback signal value is less than the detection value and the calculated variance is greater than the detection variance, then the appliance control system can assume that the pump is either operating in a dry state or is experiencing cavitation. Therefore, method (1600) can advance to (1610).

At (1610) energization of the drain pump can be discontinued. In particular, if the drain pump is operating in a dry state, then it can be assumed that the liquid was properly drained from the sump. Thus, control unit 350 can control inverter 308 to discontinue energization of a drain pump motor 304 at (1610). In such fashion, energization of the drain pump is discontinued as soon as the drain pump has properly drained the liquid from the sump and enters the dry state. Therefore, unnecessary noise and energy consumption are both reduced.

Furthermore, while the methods disclosed herein perform various actions in response to detection of a dry state or cavitation of either the wash pump or the drain pump, other actions can be performed upon detection as well. For example, a user notification can be provided, it can be determined whether additional cycles are required or desired, or any other suitable appliance operation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance comprising:

a control unit comprising a processor and a memory;

a pump comprising a three-phase motor;

an inverter for providing three-phase power to the three-phase motor; and a current measurement circuit configured to provide a feedback signal describing an inverter current drawn by the inverter across a DC bus;

wherein the control unit is configured to perform operations, the operations comprising:

detecting that the pump is cavitating or in a dry state based on the feedback signal; and controlling one or more operations of the appliance when it is detected that the pump is cavitating or in the dry state.

2. The appliance of claim 1, wherein the current measurement circuit comprises a shunt resistor positioned in a path of current flow across the DC bus.

3. The appliance of claim 1, wherein:

detecting that the pump is cavitating or in the dry state comprises determining when the magnitude of the feedback signal is less than a detection value; and controlling the one or more operations of the appliance comprises discontinuing energization of the three-phase motor when the magnitude of the feedback signal is less than the detection value.

4. The appliance of claim 3, wherein the control unit obtains the detection value from a table stored in the memory, the table providing a plurality of detection values indexed by target motor speed.

5. The appliance of claim 3, wherein the pump comprises a drain pump for draining water from the appliance.

6. The appliance of claim 1, wherein:

the pump comprises a wash pump for circulating water throughout a wash chamber of the appliance;

the appliance further comprises a heating element for heating the circulated water;

detecting that the pump is cavitating or in a dry state comprises determining when the magnitude of the feedback signal is less than a detection value; and controlling the one or more operations of the appliance comprises discontinuing energization of the heating element when the magnitude of the feedback signal is less than the detection value.

7. The appliance of claim 1, wherein:

the pump comprises a wash pump for circulating water throughout a wash chamber of the appliance;

detecting that the pump is cavitating or in a dry state comprises determining when the magnitude of the feedback signal is less than a detection value; and controlling the one or more operations of the appliance comprises adding additional water for circulation by the wash pump when the magnitude of the feedback signal is less than the detection value.

8. The appliance of claim 1, wherein:

detecting that the pump is cavitating or in a dry state comprises:

calculating a variance of the feedback signal over time; and determining when the variance of the feedback signal is greater than a detection variance; and controlling the one or more operations of the appliance comprises discontinuing energization of the three-phase motor when the variance of the feedback signal is greater than the detection variance.

9. The appliance of claim 8, wherein the pump comprises a drain pump for draining water from the appliance.

10. The appliance of claim 1, wherein:

the pump comprises a wash pump for circulating water throughout a wash chamber of the appliance;

the appliance further comprises a heating element for heating the circulated water; and detecting that the pump is cavitating or in a dry state comprises:

calculating a variance of the feedback signal over time; and determining when the variance of the feedback signal is greater than a detection variance; and controlling the one or more operations of the appliance comprises discontinuing energization of the heating element when the variance of the feedback signal is greater than the detection variance.

11. The appliance of claim 1, wherein:

the pump comprises a wash pump for circulating water throughout a wash chamber of the appliance; and detecting that the pump is cavitating or in a dry state comprises:

calculating a variance of the feedback signal over time; and determining when the variance of the feedback signal is greater than a detection variance; and controlling the one or more operations of the appliance comprises adding additional water for circulation by the wash pump when the variance of the feedback signal is greater than the detection variance.

* * * * *